United States Patent [19]

Johnson et al.

[11] 4,115,878

[45] Sep. 26, 1978

[54] SPA SAFETY DRAIN

[75] Inventors: Lawrence E. Johnson, Dana Point; William W. Conger, IV, Santa Ana; Gerald W. Moreland, Garden Grove, all of Calif.

[73] Assignee: South Pacific Industries, Santa Ana, Calif.

[21] Appl. No.: 777,034

[22] Filed: Mar. 14, 1977

[51] Int. Cl.[2] ..... E04H 3/19; A61H 9/00; A61H 33/02

[52] U.S. Cl. ..... 4/172.17; 4/180; 4/292; 128/66; 210/416 R

[58] Field of Search ..... 4/172, 172.15–17, 4/173 R, 180, 191, 195, 286, 288–292, 190; 210/163–165, 169, 220, 416 R; 137/251, 563; 128/66, 369; D23/55

[56] References Cited

U.S. PATENT DOCUMENTS

| | | | |
|---|---|---|---|
| 1,999,277 | 4/1935 | Boosey | 210/163 |
| 2,689,017 | 9/1954 | Schmid | 210/164 |
| 3,288,134 | 11/1966 | Reich | 128/66 |
| 3,345,982 | 10/1967 | Guiler | 4/180 X |
| 3,571,818 | 3/1971 | Jacuzze | 128/66 UX |
| 3,940,807 | 3/1976 | Baker et al. | 210/169 X |
| 3,943,580 | 3/1976 | Carter | 210/169 X |

FOREIGN PATENT DOCUMENTS

| | | | |
|---|---|---|---|
| 7,776 | 4/1894 | United Kingdom | 4/286 |

*Primary Examiner*—Stuart S. Levy
*Attorney, Agent, or Firm*—Gausewitz, Carr & Rothenberg

[57] ABSTRACT

A safety drain for a spa having a recirculating water pump is arranged to prevent entrapment, against the drain, of an object or person that may inadvertently block flow of water through the drain. The drain body, having a first fitting connected to the suction line of the pump, is provided with a second fitting connected to a vent conduit that has an end open to atmosphere at a point above water level. A by-pass conduit interconnecting the pump suction line and the vent conduit avoids disablement of the safety function of the vent conduit if the latter should become blocked within the drain.

10 Claims, 4 Drawing Figures

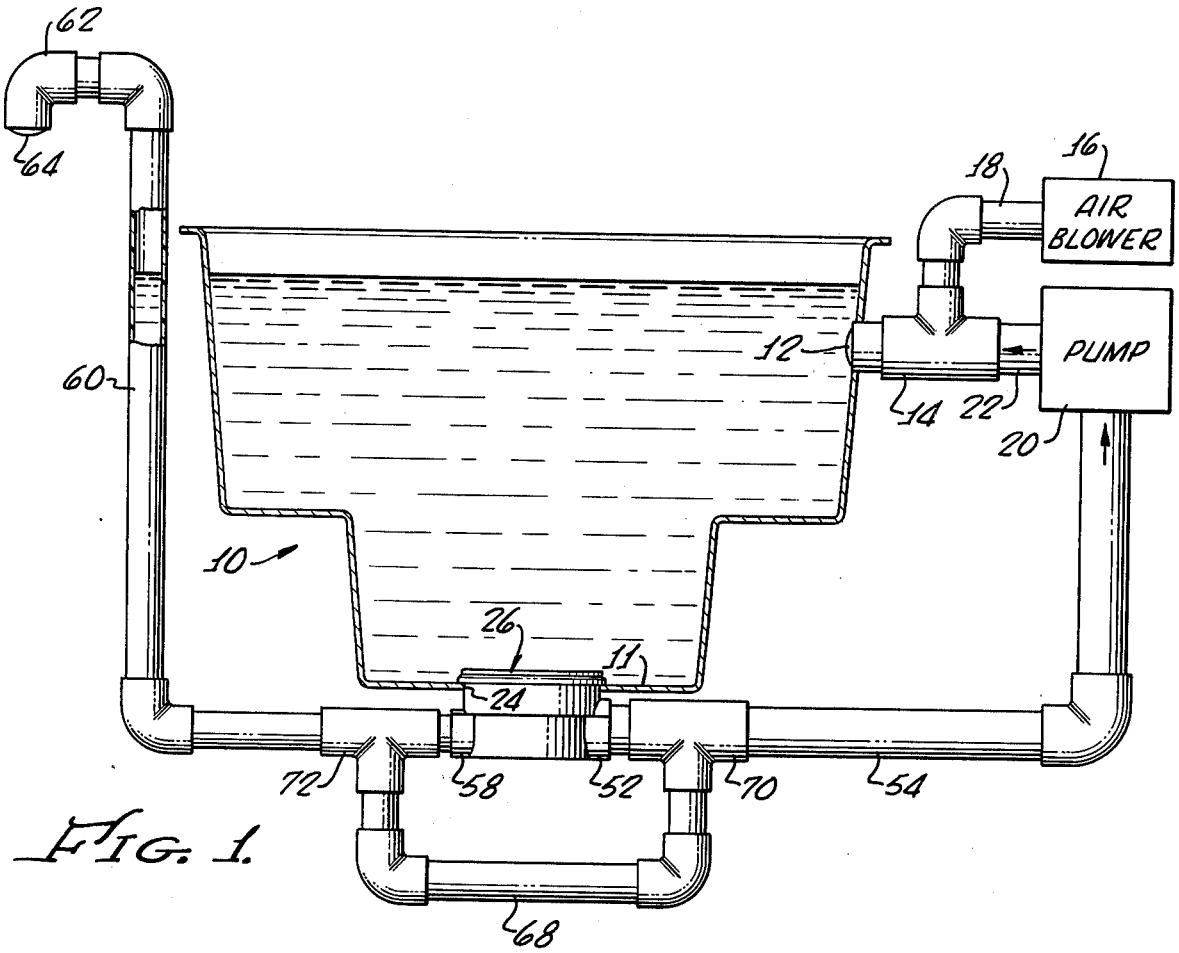
FIG. 1.
FIG. 3.
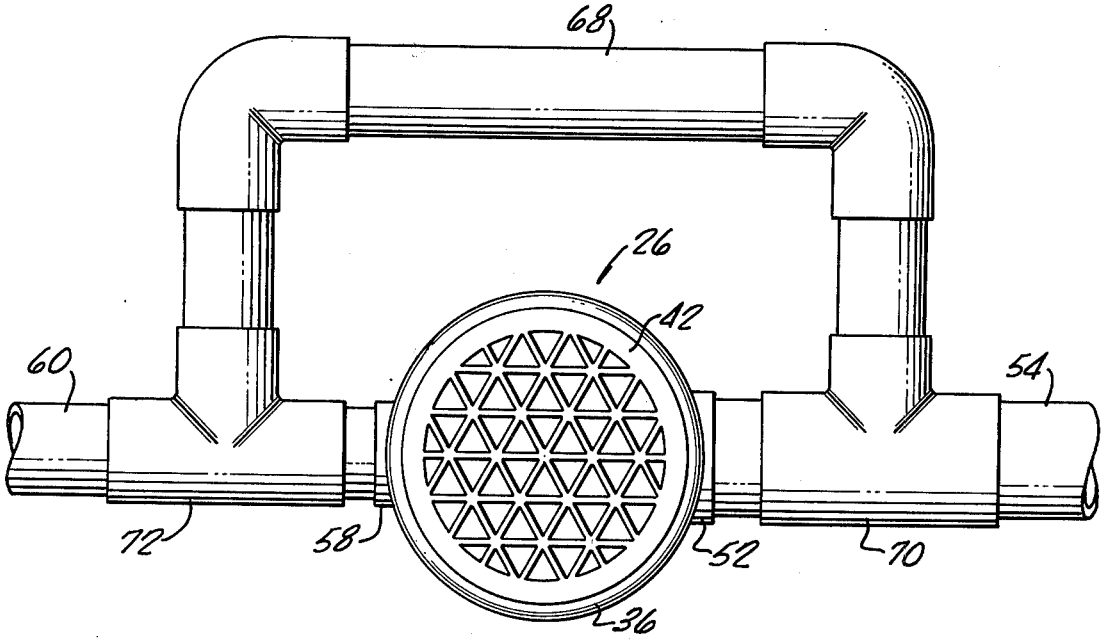

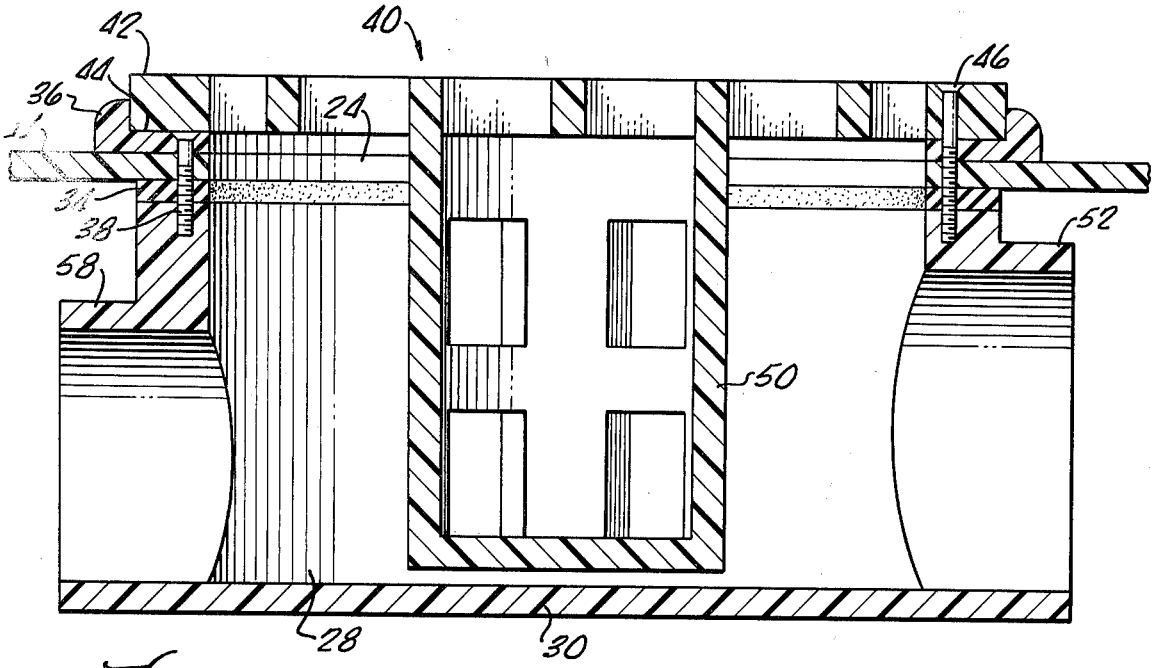
FIG. 2.
FIG. 4.
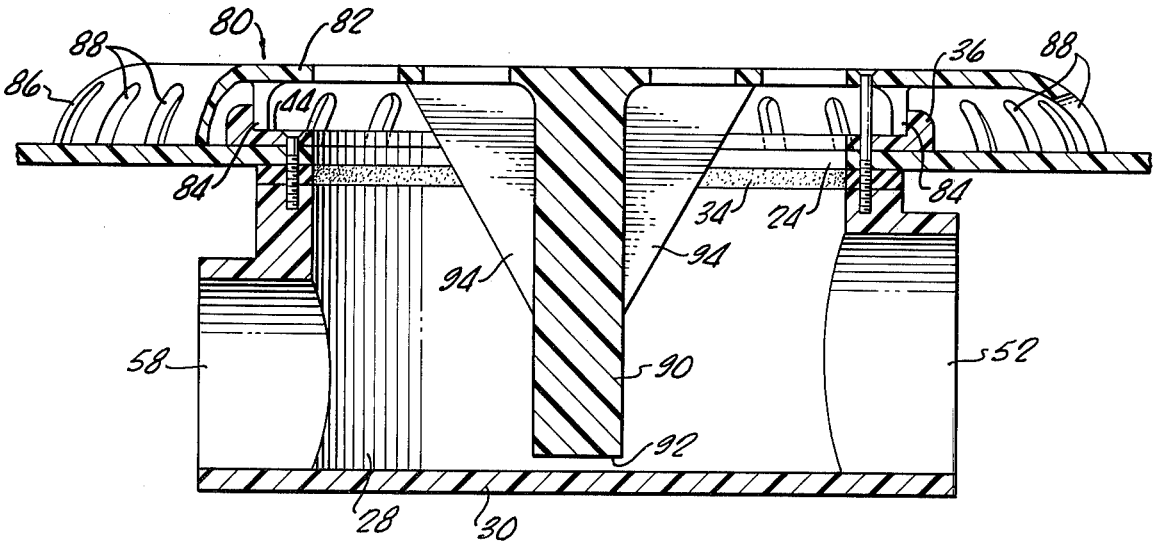

SPA SAFETY DRAIN

BACKGROUND OF THE INVENTION

The present invention relates to spas or therapy pools and more particularly concerns an improved drain arrangement which will avoid entrapment of an object or person that may inadvertently block the drain.

The common spa or therapy pool designed for home use is much like a conventional swimming pool in that it includes a water containing shell, drain and inlet connections, and a recirculating water pump forcing water into the pool through the inlet connection and extracting water from the pool through the drain connection. One of the significant differences between the conventional swimming pool and the spa or therapy pool is the size of the water container. Whether such a spa is designed and built as an adjunct of the conventional swimming pool, to be operated together with the pool, or is designed and built to be operated as a totally independent unit, it is generally of a considerably smaller size and depth. Therefore, the person using the spa is normally positioned much closer to the spa drain than such person would be when using the conventional swimming pool. In the latter case the drain, which is generally located at the bottom of the deepest section of the pool, may be from 6 to 10 feet below the water surface. In the case of the spa, the drain, also positioned in the bottom at a lower point (which is often in the center of the spa tub or shell), may be only a few feet from the surface. Thus, in the use of the spa there is a considerably greater likelihood that the user will come into contact with the drain.

Such contact with the drain can be dangerous, painful or even fatal. A typical drain is 5 to 8 inches in diameter and thus it is possible that the body of a person, when positioned in close proximity to the drain, may be drawn down upon the surface of the drain cover to thus completely block the drain openings. If the drain is blocked, the person may be entrapped and drowned.

A commonly used recirculating spa pump of 1½ to 2 horsepower can draw a vacuum as high as 22 to 26 inches of mercury. A vacuum of this magnitude, drawn upon a drain opening, even where such opening is as small as 5 inches, may exert sufficient suction forces to prevent a young person, or even some adults, from pulling free of the forces exerted by a drain that is completely blocked by the body or clothing of such person. If the person is able to pull free of the sucking drain, bruises or welts may result. In at least one case, a child has been drowned in a spa when his abodmen inadvertently covered and blocked the drain, whereby he was entrapped at the bottom of the spa and unable to break free.

Where a spa or therapy pool is provided with a skimmer having an intake just below the water surface and a connection to the pump suction line, such a skimmer when operating properly will operate to relieve dangerous suction at a blocked main drain. However, such skimmers are generally provided with valves to adjust relative flow of water through the skimmer and through the main drain, which valves are easily and often closed to completely stop the skimmer action. Further, the skimmer by its very nature incorporates a strainer or basket having relatively small openings and such basket is frequently plugged when overloaded with debris or floating objects such as balls or plastic toys and the like. Even where a skimmer is provided, its intake is below the water surface and thus it withdraws water from the pool at all times so that the skimmer valve is often closed to disable the skimmer when the spa is in use. Further, should the main water level drop below the level of the skimmer input, recirculation is disabled because the pump will suck air through the skimmer. Therefore, the skimmer is not and cannot be a true safety device and, in fact, has not been accepted or approved as such by government officials having regulatory authority over safety of spas and swimming pools.

Accordingly, it is an object of the present invention to provide a reliable safety device for spa drains that eliminates or minimizes the above-mentioned problems.

SUMMARY OF THE INVENTION

In carrying out principles of the present invention in accordance with a preferred embodiment thereof, a spa having a drain that is connected to the suction line of a recirculating water pump is provided with a vent conduit that is connected to the drain and which has an intake open to the atmosphere and positioned above the water level. Preferably the vent conduit and the water pump suction line are connected to the drain at mutually spaced points thereof and a by-pass conduit is connected to and between the pump suction line and the vent conduit so that if the vent conduit is blocked within the drain, it will still have an operating connection, via the by-pass conduit, to the pump suction line to avoid entrapment of an object or person. In conjunction with the vent conduit an improved anti-entrapment and strengthened drain cover is provided to extend over an area considerably greater than the drain opening and having a downwardly projecting peripheral flange providing a pattern of input passages to the drain. This pattern is spread over a large area so that all of such passages are less likely to be blocked at one time. Further, the drain cover or grate is provided with a downwardly projecting pedestal that allows a small amount of grate deflection but which provides additional support to limit deflection and prevent concomitant breakage.

BRIEF DESCRIPTION OF THE DRAWINGS

FIG. 1 is a schematic view of a spa or therapy pool system embodying the safety drain of the present invention showing the by-pass line at 90° to its preferred position;

FIG. 2 is an enlarged side view of the drain of FIG. 1;

FIG. 3 is a plan view of the drain showing the several conduits and water lines connected thereto, and showing the by-pass line in its preferred position; and FIG. 4 is a view of the drain of FIG. 1 having a modified drain cover.

DETAILED DESCRIPTION

As shown in FIG. 1, a typical therapy pool or spa includes a water-tight tub or shell 10 of approximately 3 to 10 feet or more in diameter and of 3 to 4 or 5 feet in depth, although sizes and horizontal and vertical configurations are widely variable according to individual desires and preferences. The spa has a plurality of aerator inlet nozzles such as nozzle 12 (only one nozzle is shown) which are spaced about the periphery of the spa shell and connected to an aerator fitting 14. Aerator fitting 14, which is a known arrangement for mixing air and water, is conventionally connected to an air blower 16 by means of an air pressure conduit 18 and is also connected to a recirculating water pump 20 by means of a water pressure line 22.

At a lowermost point of the spa shell, there is formed a drain opening 24 in which is inserted a drain generally indicated at 26. The drain may be of many different sizes and configurations but, in the preferred embodiment illustrated in FIG. 2, comprises a generally cylindrical body having sidewalls 28, a bottom 30, and an open top. The drain body is mounted to the spa in any one of a number of conventional arrangements. As shown in FIG. 2, the drain body is positioned below the bottom 11 of the spa with a gasket 34 interposed between the drain and the spa bottom. A clamp ring 36 is positioned above the spa bottom 11, having an opening in registry with the drain and spa bottom openings, and secured to the spa bottom and drain by means of a plurality of screws, such as indicated at 38.

The open top of the drain is protected by a perforated grate 40 having a lid 42 covering the opening and extending beyond the drain opening. The lid includes a top section seated upon an upwardly and inwardly facing shoulder 44 of the clamp ring. The grate is fixed to the clamp ring and to the drain body by means of a plurality of screws 46 that extend through the lid and clamp ring for threaded engagement in the drain body. To further strengthen the grate and prevent breakage, a pedestal 50 in the form of a short cylindrical body is fixed to the underside of the grate lid 40 and depends therefrom to a point close to but spaced above the drain bottom 30. Thus, should a heavy downward force be placed upon the grate, it would deflect downwardly together with pedestal 50 until the bottom of the latter contacted the drain bottom, at which time further support for the mid-portion of the grate lid would be provided to thus considerably strengthen the lid while retaining a degree of flexibility.

Extending horizontally from the sidewall of the drain sidewalls is a suction fitting 52 which is connected to a suction line 54 which in turn is connected to the intake of pump 20. Thus the pump will recirculate water of the spa, drawing water from the drain via fitting 52 and suction line 54 and forcing water back into the spa via pressure line 22, aerator fitting 14 and inlet nozzle 12.

With the drain components described up to this point, and assuming for the purposes of this discussion that the venting arrangement to be described below is not included, this spa presents a major hazard to a user who may inadvertently contact the drain grate 40 and, by means of loose and relatively impervious clothing, or by means of contact of the person's body, block all or substantially all of the openings in the drain grate. Should such openings be blocked, the pump continues to run but will rapidly extract all water from the drain and draw a vacuum within the drain body of as high as 22 to 26 inches of mercury. As previously mentioned, even with a drain diameter no greater than 5 inches, a vacuum of this magnitude may exert a force upon a person that is beyond the strength of such person to overcome. Such person could, therefore, become entrapped against the drain and might drown.

The present invention provides a simple, reliable and trouble free arrangement that will help to avoid the creation of such a vacuum in the drain. No springs, valves, electrical components or moving parts of any type are employed.

In order to insure that such a large magnitude vacuum will not be produced within the drain, the drain body is provided with a second fitting 58 that is connected to a vent conduit 60 having an end 62 that is positioned above the level of the water in the spa and preferably above the uppermost portion of the spa itself. Inlet end 62 of the vent conduit 60 is provided with a perforate end cap 64 to avoid entrance of objects that could block the vent conduit. Further, the inlet end 62 is preferably positioned in a location remote from the tub that is not easily or normally accessible or otherwise subject to inadvertent blockage.

With the described vent conduit, complete blockage of the drain by covering all of the apertures in grate 40, will not result in a vacuum of great magnitude within the drain since the interior of the drain is connected with the atmosphere via conduit 60. Thus the pressure within the drain can drop below atmospheric pressure only by the relatively small amount of pressure drop between the end 62 of the vent conduit and the fitting 58.

It is possible, nevertheless, under certain circumstances, that the end of vent conduit 60 connected to fitting 58 may be blocked within the drain itself. Breakage of the lid of the drain grate could result in an object entering the interior of the grate and contacting the opening of fitting 58, within the drain, thereby blocking communication between the vent conduit and the drain. In such a situation, without the by-pass to be described below, the drain still could be blocked and exert an entrapping and possibly fatal force. To eliminate this possible disabling of the safety operation of the vent conduit 60, there is provided a by-pass conduit 68 having one end connected to the pump suction line 54 by means of a T-fitting 70 that is connected in the suction line. The other end of the by-pass conduit is connected to the vent conduit 60 by means of a T-fitting 72 connected in the suction line. Both of the T-fittings 70 and 72 are preferably connected close to the drain to minimize required conduit lengths. The by-pass conduit is shown below the drain in FIG. 1 (and shifted 90° from its preferred position) only for clarity of the drawing. It is preferred to position this conduit at the level of the suction line 54 and the lower part of vent conduit 60. The latter arrangement is shown in FIG. 3.

With use of the by-pass conduit 68, even blockage of the drain connection to conduit 60, that is, blockage of fitting 58 within the drain, will not disable the entrapment preventing operation of conduit 60. If fitting 58 is blocked, the higher atmospheric pressure at conduit end 62 may still be communicated to the interior of the drain via vent conduit 60, T-fitting 72, by-pass conduit 68, T-fitting 70, and the line between fittings 52 and 70.

Preferably fitting 58 is smaller than the fitting 52, thereby to decrease the flow of water from the drain via fitting 58 and by-pass conduit 68. Further, it is important that the fittings 58 and 52 be spaced from each other by a significant distance. In the described arrangement, the fittings are radially directed outwardly and positioned at diametrally opposed points on the periphery of the drain. This provides a relatively large cross-section of flow path between fittings 58 and 52 in the event of blockage of the drain or grate and thus allows a rapid decrease in any vacuum that might be drawn within the drain under such conditions. This large cross-sectional area path also minimizes the possibility of blockage of the flow path within the drain between fittings 58 and 52, thus further enhancing the reliability of this safety system even though the by-pass 68 provides a redundant or parallel path between fittings 58 and 52. Fitting 58 alternatively may be connected to the drain bottom.

It is found that mere connection of a vent conduit to the suction line of the pump will disable the recirculation system since, as in a conventional skimmer having its intake above the main water level, the pump will rapidly extract all water from the vent conduit and thereupon start drawing air instead of water. Surprisingly and unexpectedly, the vent conduit, when connected as shown and described in this application, does not disable the pump, whether or not the by-pass line 68 is employed.

It is postulated that connection of a vent line directly to the pump suction line establishes a venturi effect at such connection which then supplies air to the pump intake to disable recirculation.

In the illustrated vent connection, on the other hand, several factors may possibly contribute to the unexpected and surprising result of retention of water in the vent conduit during normal recirculation of water via the drain. These factors may diminish a venturi effect by decreasing flow of velocity of water past the lowermost end of the vent conduit. The area of the drain is relatively large and therefore flow velocity through the drain is relatively small. The vent conduit has a separate connection to the drain and is not merely connected to the suction line. Fitting 58 is smaller than fitting 52. Further, to the extent that water flows from the drain via "T" 72 and the by-pass conduit, there is a lesser flow and more resistance to flow of water from the vent conduit to the pump suction line.

Illustrated in FIG. 4 is a modified version of the grate or drain cover 40 shown in detail in FIG. 2. As shown in FIG. 4, grate 80 includes an apertured lid or plate 82 of a horizontal configuration similar to that of the drain, which in this case is circular. However, the lid covers a greater area, having a diameter considerably greater than the diameter of the drain. Inwardly of the edges of plate 82 is a downwardly projecting annular grate support 84 that is adapted to rest upon the shoulder 44 of rim 36 to support and secure the grate to the rim and, further, to space the lid 82 above the open top of the drain. Screws extending through the lid 82 and screws extending through the rim into the drain fixedly secure the grate to the drain and to the spa bottom.

The grate has a peripheral downwardly projecting flange 86 formed integrally therewith. The flange has a lower edge in contact with or spaced just above the bottom of the spa at points positioned considerably outwardly of the drain itself. Flange 86 is formed with a number of passages to permit flow of water radially of the grate through the flange along the bottom of the spa and below the lid 82 and thence into the drain. Although these passages may be provided as a number of peripherally spaced apertures extending through the flange, it is convenient to form the bottom edge of the flange in an irregular form, such as with a plurality of recesses or slots 88, or as a scalloped edge, to thereby define a plurality of radially directed water flow passages between the flange and the spa bottom. These peripheral passages are in addition to the apertures formed in the horizontally extending central portion of the lid, which apertures are similar to those illustrated in FIG. 3.

Integrally formed with and depending from a central portion of the lid 82 is a pedestal 90 having a lower end 92 that is positioned closely adjacent to but spaced above the bottom of the drain. A plurality of strengthening gussets 94 are formed integrally with the pedestal and lid, extending radially outwardly from the pedestal to further strengthen the grate. Thus the grate may deflect for a small distance, such as 3/16ths of an inch for example, until the bottom of the pedestal contacts the drain bottom whereupon the central portion of the lid acquires a strong support to prevent further deflection and decrease the possibility of breakage of the grate.

The relatively great extent of the grate and the location of input passages about its periphery, provide a plurality of input passages grouped in a pattern that minimizes the possibility that all of these will be blocked at one time. Thus this particular grate configuration provides a further redundant safety feature to still further minimize the possibility of buildup of a dangerous suction within the drain.

The described safety venting of the drain is effective and reliable. Redundant features are employed so that although likelihood of certain failure modes are minimized by the design, the occurrence of such failures will not render the safety system inoperable. The system is of the utmost simplicity, involving no electrical, electro-mechanical, or other moving parts, and thus will exhibit high reliability over a long life of operation in a highly corrosive environment.

The foregoing detailed description is to be clearly understood as given by way of illustration and example only, the spirit and scope of this invention being limited solely by the appended claims.

What is claimed is:

1. In a spa including a shell with a water inlet, a drain completely submerged at the bottom of said shell, a recirculating water pump having a suction line connected to the drain and a pressure line connected to the inlet, the improvement comprising safety apparatus for decreasing suction forces exerted upon an object or person that may inadvertently block flow of water into the drain, to thereby avoid entrapment of such object or person at the drain, said apparatus comprising a vent conduit having an end at the bottom of said shell connected with said drain and having an intake open to atmosphere and positioned above water level of said shell, said vent conduit extending externally of said shell and upwardly from said drain and the bottom of said shell to said intake; a drain by-pass conduit connected to and between said pump suction line and said vent conduit, whereby blockage of said vent conduit within said drain will not disable operation of said vent conduit to avoid entrapment.

2. The apparatus of claim 1 wherein said drain comprises an open top body and wherein said suction line and said vent conduit are connected to substantially spaced points of said body.

3. The apparatus of claim 1 including means for restricting flow through said by-pass and vent conduits relative to flow through said suction line.

4. The apparatus of claim 3 wherein said drain comprises a body having an open top positioned at the bottom of said shell and having side walls extending below the bottom of said shell and wherein said pump suction line and said vent conduit are connected to said body side walls at points mutually spaced by a major dimension of said body.

5. A spa comprising a water containing shell having side walls and a bottom, a water inlet in said shell, a pump having a pressure line connected to said inlet, and having a suction line, a drain mounted in said shell, said drain having an open top positioned substantially at said bottom and having wall portions extending below said shell bottom, said drain having first and second drain fittings in said wall portions below said shell bottom, said first fitting being connected to said pump suction line, and a vent conduit having one end connected to said second drain fitting and the other end open to atmosphere at a point above water level of said shell;

a drain by-pass conduit connected to and between said pump suction line and said vent conduit, whereby blockage of said vent conduit within said drain will not disable operation of said vent conduit to avoid entrapment.

6. The spa of claim 5 wherein said drain includes a bottom, and including a protective grate overlying said drain, said grate including a perforate lid spaced about and covering said drain and extending beyond said drain wall portions on all sides, means for securing said lid to and supporting it from said drain, said lid having a circumferential flange projecting downwardly therefrom, said flange being formed with passage means for flowing water to said drain from a plurality of points adjacent the periphery of said lid and spaced radially outwardly of said drain wall portions.

7. The spa of claim 5 wherein said second fitting is smaller than said first fitting.

8. The spa of claim 5 wherein said drain comprises a body having a bottom and an open top, a grate secured to and extending across said top in spaced relation thereto, and a pedestal fixed to said grate and projecting therefrom to a point close to but spaced from said drain bottom.

9. The spa of claim 5 wherein said drain fittings extend radially outwardly from said wall portions at points mutually spaced about the periphery of the body, said vent conduit extending externally of said shell, outwardly from said drain wall portions and upwardly from said shell bottom.

10. A spa comprising a water containing shell, a water inlet in said shell, a pump having a pressure line connected to said inlet, and having a suction line, a drain mounted in said shell and having first and second drain fittings, said first fitting being connected to said pump suction line, a vent conduit having one end connected to said second drain fitting and its other end open to atmosphere at a point above water level of said shell, said drain including sidewalls and a bottom, a protective grate overlying said drain and including a perforate lid spaced about and covering said drain and extending beyond said drain sidewalls on all sides, means for securing said lid to and supporting it from said drain, said lid having a circumferential flange projecting downwardly therefrom, said flange being formed with passage means for flowing water to said drain from a plurality of points adjacent the periphery of said lid and spaced radially outwardly of said drain sidewalls, and a pedestal carried by said lid and projecting downwardly therefrom to a point close to but spaced from said drain bottom whereby a relatively small amount of downward deflection of said lid will cause said pedestal to abut said bottom to provide further support for said lid.

* * * * *